US008864421B2

(12) United States Patent
Asplin

(10) Patent No.: US 8,864,421 B2
(45) Date of Patent: Oct. 21, 2014

(54) STRUCTURE LIFTING METHOD AND APPARATUS

(71) Applicant: Charles L. Asplin, Fargo, ND (US)

(72) Inventor: Charles L. Asplin, Fargo, ND (US)

( * ) Notice: Subject to any disclaimer, the term of this patent is extended or adjusted under 35 U.S.C. 154(b) by 10 days.

(21) Appl. No.: 13/785,536

(22) Filed: Mar. 5, 2013

(65) Prior Publication Data

US 2014/0255105 A1 Sep. 11, 2014

(51) Int. Cl.
*E01C 23/10* (2006.01)
*B66F 3/24* (2006.01)
*E02D 37/00* (2006.01)

(52) U.S. Cl.
CPC . *B66F 3/24* (2013.01); *B66F 3/247* (2013.01); *E02D 37/00* (2013.01)
USPC ..... 405/230; 404/78; 52/126.1

(58) Field of Classification Search
USPC ..... 405/229, 230; 404/78; 52/126.5, 126.1, 52/742.14, 742.13
See application file for complete search history.

(56) References Cited

U.S. PATENT DOCUMENTS 4,495,738 A * 1/1985 Sheber ..... 52/204.1
5,561,914 A 10/1996 Asplin
5,860,763 A 1/1999 Asplin
5,979,879 A 11/1999 Asplin
6,976,804 B1 12/2005 Asplin
7,226,274 B1 6/2007 Asplin
7,461,997 B1 12/2008 Mack, II
8,092,116 B1 1/2012 Asplin
8,186,907 B1 5/2012 Asplin
2006/0117678 A1 6/2006 Neighbours

FOREIGN PATENT DOCUMENTS

JP 03-047305 2/1991
JP 06-146213 5/1994
JP 2002-146717 5/2002

* cited by examiner

*Primary Examiner* — Sean Andrish

(74) *Attorney, Agent, or Firm* — Hamre, Schumann, Mueller & Larson, P.C.

(57) ABSTRACT

A method of lifting a structure using one or more inflatable hoses is described. In one embodiment, a method of lifting a structure resting on the ground includes attaching a lift apparatus to the structure to the raised. An inflatable hose is introduced underneath the lift apparatus, with the inflatable hose being disposed between a bottom surface of the lift apparatus and the ground. The structure is then lifted by inflating the hose with pressurized media so that the hose increases in volume to impose an upward force on the lift apparatus which in turn lifts the structure.

14 Claims, 4 Drawing Sheets

STRUCTURE LIFTING METHOD AND APPARATUS

FIELD

This disclosure relates to a method and apparatus of lifting a structure. The structure can be any structure that one may want to lift, for example a structure that has settled and needs to be lifted to return the structure to its original level, or a structure that one wants to raise from an original level to a higher level.

BACKGROUND

Over time, many structures, such as roadways, driveways, houses or portions thereof, garage floors, porches, sidewalks, patios, etc., have a tendency to settle or sink and need to be raised upwardly to return the structure to its original level. In addition, it is sometimes desirable to lift a structure upwardly, even a structure that has not settled, from a first level to a second higher level.

U.S. Pat. No. 8,092,116 describes the use of an inflatable hose or hoses to raise a slab.

SUMMARY

A method of lifting a structure using one or more inflatable hoses is described. The described method is more efficient than conventional raising methods such as slab re-forming and mud jacking.

In one specific application, the described method can be used to lift a structure while the structure remains in use. The described method can be used to lift any structure that one may wish to lift. Examples of structures that can be lifted include, but are not limited to, roadways, driveways, houses or portions thereof, garage floors, porches, sidewalks, patios, etc.

In one embodiment, a method of lifting a structure resting on the ground includes attaching a lift apparatus to the structure to the raised. An inflatable hose is introduced underneath the lift apparatus, with the inflatable hose being disposed between a bottom surface of the lift apparatus and the ground. The structure is then lifted by inflating the hose with pressurized media so that the hose increases in volume to impose an upward force on the lift apparatus. The lifting could be aided or supplemented by other lifting techniques such as mudjacking or the use of compressed air.

In another embodiment, a method of raising a structure includes attaching a lift apparatus to the structure to the raised. An inflatable hose is then positioned underneath the lift apparatus, with the inflatable hose being positioned underneath the lift apparatus so as to be able to impose an upward lifting force on the lift apparatus when the hose is inflated. The hose is then inflated with pressurized media so that the hose increases in volume to impose an upward force on the lift apparatus to lift the structure. Fill material is then introduced into a space that is created underneath the structure when the structure is lifted. Thereafter, the inflated hose is deflated. The inflating and filling steps can optionally be repeated to raise the structure the desired height.

Multiple lifts are easy to perform by just adding blocking under the hose after introducing the fill material upon each iteration of lift.

DRAWINGS

DETAILED DESCRIPTION

A method of lifting a structure is described that can be used to lift a structure needing to be raised. For purposes of explaining the inventive concepts, the method will be described with respect to raising a sunken floor of a garage. However, the described method can be used to lift any structure that one may wish to lift. Other examples of structures that can be lifted include, but are not limited to, roadways, driveways, houses or portions thereof, porches, sidewalks, patios, etc. In addition, the structure to be lifted need not be a sunken structure, i.e. a structure that needs to be raised from a sunken level to an original level. Rather, the described method can be used to lift a structure from a first, original level to a higher, second level. The structures to be lifted will generally be described as being formed from concrete. However, in appropriate circumstances, the concepts described herein may be used to raise structures formed from other materials, such as asphalt, metal or wood.

Figure 1:
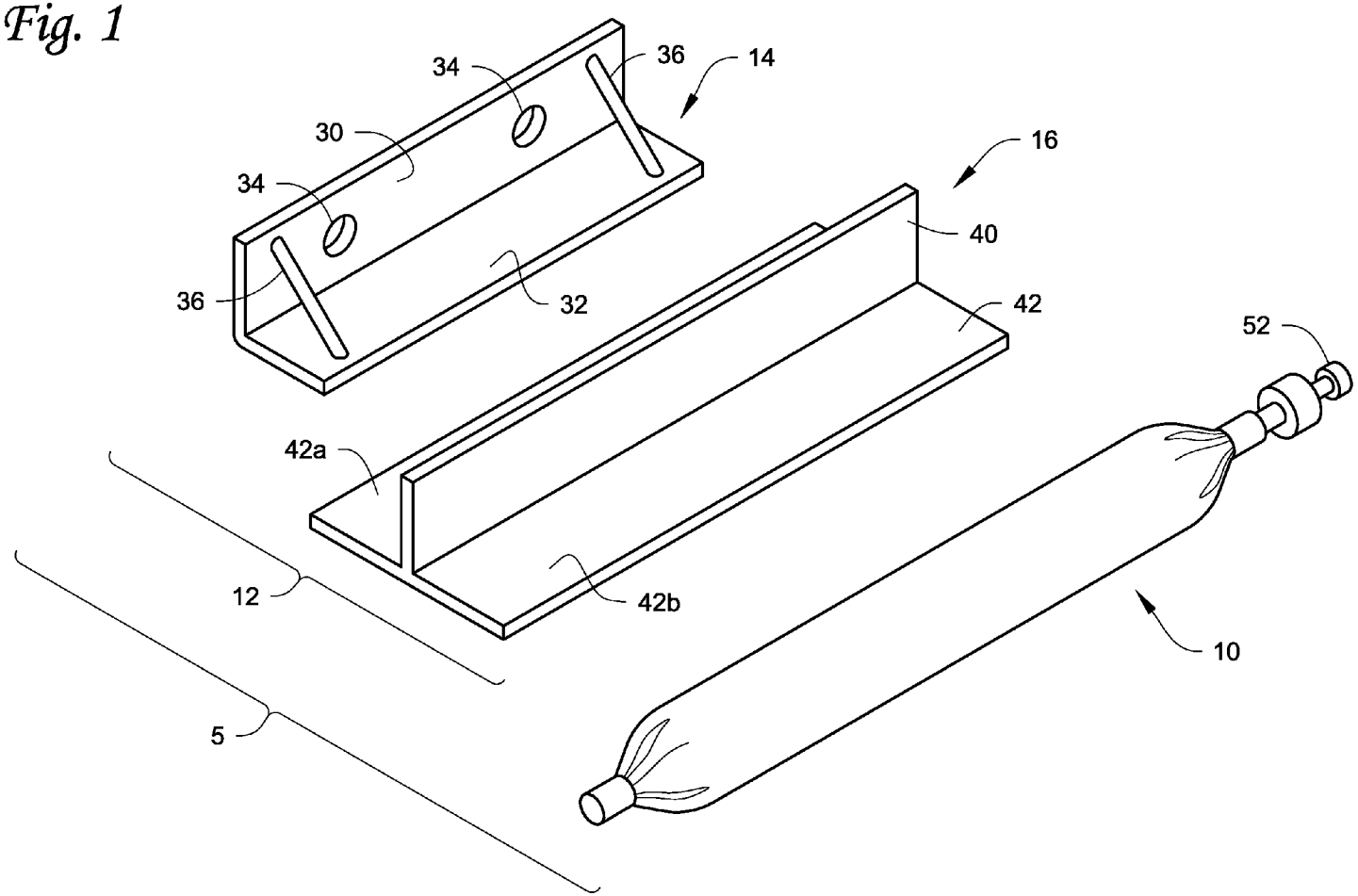
FIG. 1 illustrates the primary components of the lifting mechanism used in the structure lifting method described herein.

With reference to FIG. 1, the primary components of the lifting mechanism 5 used in the described structure lifting method are illustrated. The components include an inflatable hose 10 and a lift apparatus 12 that in use is designed to be attached to the structure to be lifted and transfer a lifting force from the hose 10 to the structure to be lifted. The lift apparatus 12 can take on any configuration one finds suitable for transferring a lifting force from the hose to the structure. In the illustrated example, the lift apparatus 12 can include two parts, namely an angle bracket 14 that in use is rigidly fixed to the structure to be lifted and a lift bracket 16 that is loosely disposed between the angle bracket 14 and the hose 10 to transfer the lifting force from the hose to the angle bracket. However, a single-piece lift apparatus that performs the functions of both the angle bracket and the lift bracket could be used.

Figure 2:
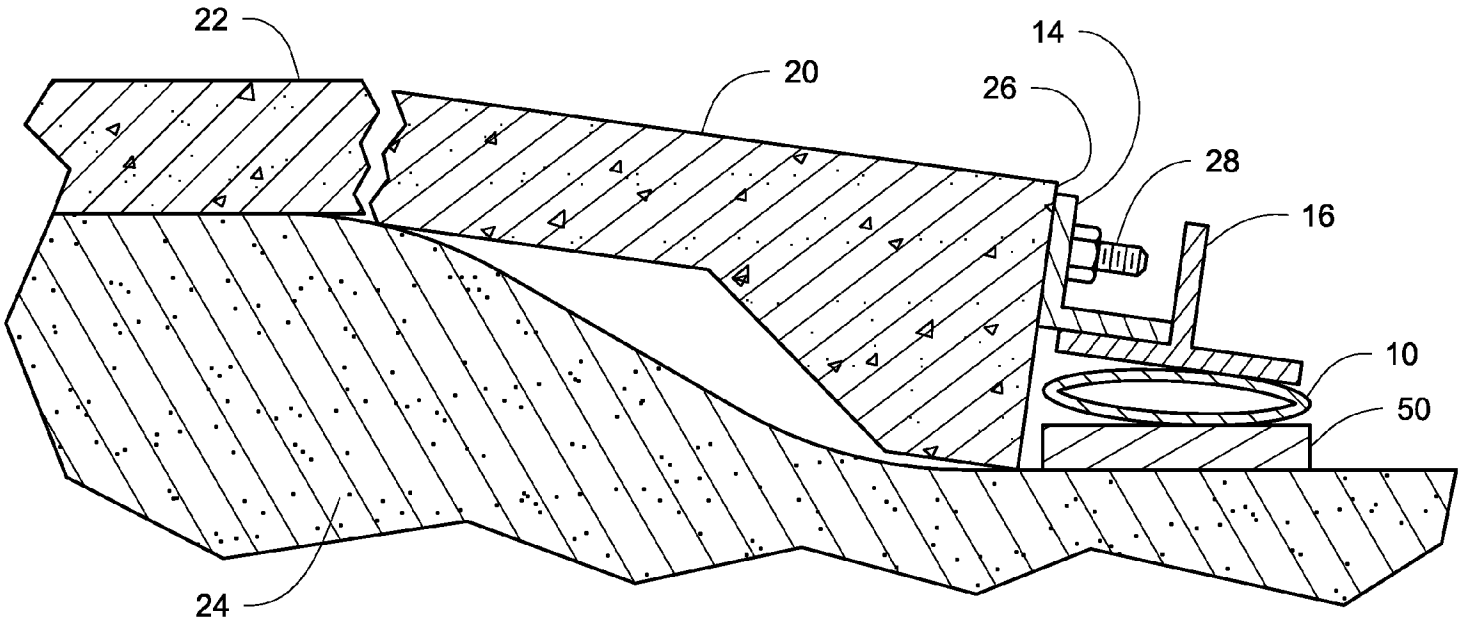
FIG. 2 illustrates the lifting mechanism in place to lift a structure before inflating the hose.

Turning to FIG. 2, the lifting mechanism is shown in position for lifting a portion 20 of a garage floor 22 that has settled or sunken. Normally, the garage floor 22 rests on the ground 24 at a first, level position. But over time, portions of the ground underneath the floor 22 can subside or wash away, causing the portion 20 to settle or sink relative to the remainder of the floor 22. The portion (or structure) 20 needs to be lifted upward to raise the portion back to its level position with the remainder of the floor. The situation illustrated in FIG. 2 is one example of a settling scenario. It is possible for the entire floor 22 to settle in which case the entire floor needs to be raised.

As shown in FIG. 2, the angle bracket 14 is attached to one edge 26 of the floor portion 20. For example, the angle bracket 14 can be bolted to the edge 26 using one or more threaded bolts 28 that can be embedded into the structure 20. The angle bracket 14 can include a first, generally planar vertical section 30 and a second, generally planar horizontal section 32 that is connected to the first section 30 at a 90 degree angle thereto. As seen in FIG. 1, a pair of holes 34 are formed in the first section 30 to allow passage of the bolts 28. A pair of optional reinforcing members 36 can be provided adjacent to the ends of the angle bracket and that extend between the first section 30 and the second section 32 to help reinforce the bracket 14.

With reference to FIG. 1, the lift bracket 16 is an upside down, T-shaped structure with a stem 40 and a cross-bar 42 having a pair of legs 42*a*, 42*b*. As shown in FIG. 2, in use, the lift bracket 16 is arranged such that it is loosely disposed between the hose 10 and the angle bracket 14, with the leg 42*a* disposed underneath the second section 32 and the hose underlying the cross-bar 42.

The hose is positioned underneath the lift bracket 16 so as to be able to impose an upward lifting force on the lift bracket 16, and thereby on the structure 20 via the angle bracket 14, when the hose is inflated. In the illustrated embodiment, the hose 10 is disposed between the cross-bar 42 of the lift bracket and the ground 24. As illustrated in FIG. 2, a support plate 50 may be introduced between the hose and the ground to help to stabilize the hose relative to the ground. However, the support plate 50 is optional and the hose 10 may rest directly on the ground if the ground provides enough support for the hose.

Figure 3:
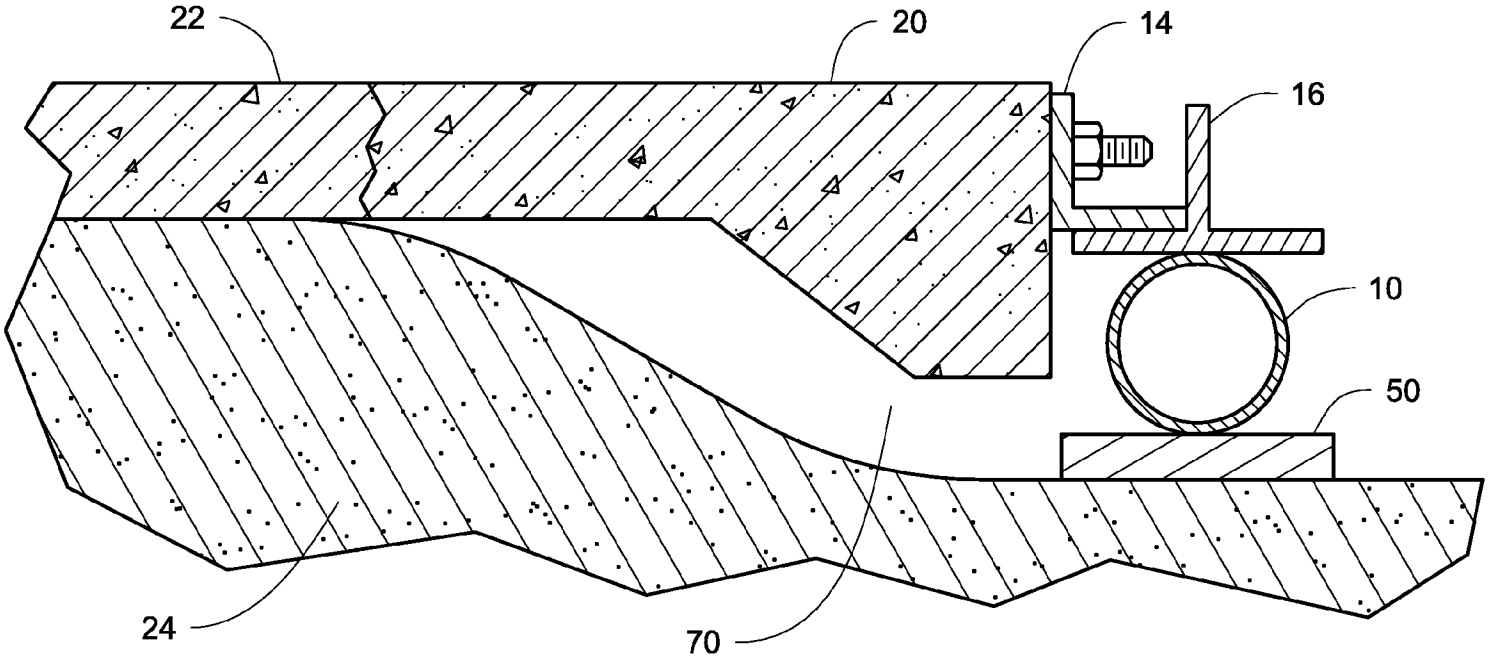
FIG. 3 is similar to FIG. 2 but with the hose inflated to lift the structure.

FIG. 3 shows the hose 10 in an inflated state. The hose 10 is inflated with pressurized media so that the hose 10 increases in volume to impose an upward force on the structure 20. Suitable pressurized media for inflating the hose includes, but is not limited to, pressurized gases such as air and pressurized liquids such as water. The pressurized media can be generated from a pressurized media source 60 (see FIG. 5) and is injected into the hose 10 through one end thereof. To accomplish the injection of the media, the end of the hose can be provided with a suitable fitting 52 as illustrated in FIG. 1. The opposite end of the hose 10 can be closed to prevent escape of the pressurized media. Alternatively, the opposite end can be connected back to the media source 60 to form a closed loop circulation system.

The increase in size of the hose resulting from inflation creates an upward lifting force on the structure that is sufficient to lift the structure. The size of the hose that is used should be sufficient to lift the structure upward a sufficient distance to raise the structure to the desired level. Further, the hose need not be fully inflated. The hose only need be inflated enough to raise the structure to the desired level. In addition, the size of the hose and pressure of the pressurized media should be sufficient to create enough upward lifting force to lift the weight of the structure 20. When it is desired to implement the method while the structure remains in use, the upward force should be sufficient to support both the structure and any objects on the top surface of the structure. In this manner, the structure can be raised while the structure remains in use.

Although the hose 10 is illustrated as having a circular cross-sectional shape when fully inflated, hoses having other cross sectional shapes can be used, such as rectangle, polygon, oval or irregular shapes. For example, a hose with an oval cross sectional shape when fully inflated can be used. The hose 10 can be made from any suitable material, such as rubber, canvas or nylon, so long as the hose 10 is inflatable to increase the volume from a collapsed or non-pressurized condition, and can hold the pressurized media when inflated.

Figure 4:
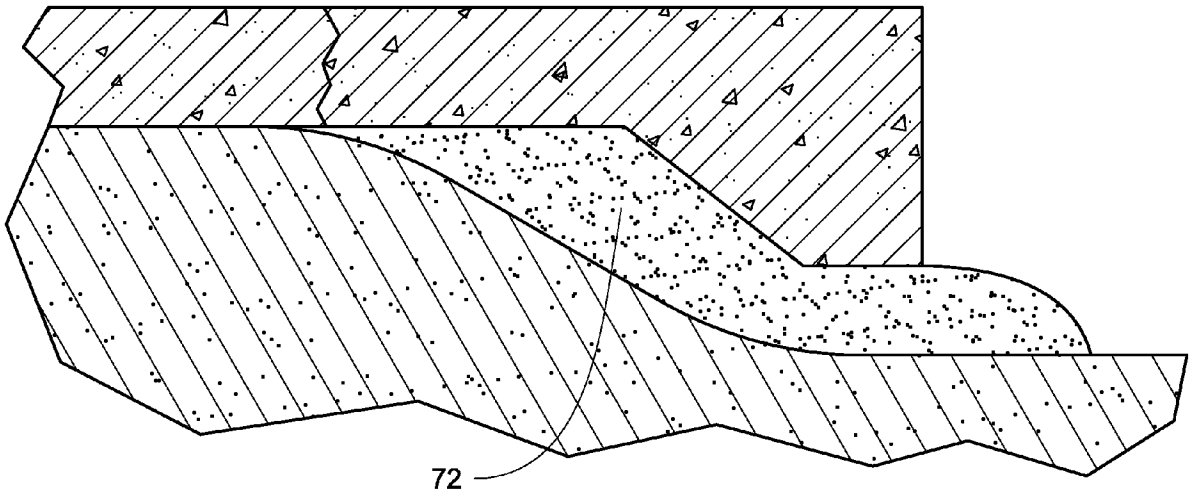
FIG. 4 illustrates fill material introduced underneath the structure to keep the structure raised.

As shown in FIG. 3, once the structure 20 is lifted by the inflated hose 10, an open space 70 is created underneath the structure 20. Fill material 72 is then introduced into the space 70 to fill the space and restore support to the structure as shown in FIG. 4. The fill material can be any material suitable for filling the space 70. Examples of suitable fill material include, but are not limited to, dried fill material such as dried sand or wet fill material such as conventional mud used in mud jacking. Dried fill materials are useful because they do not need time to dry. If wet fill material is used, drying time must be provided. An explanation of using dried sand and other dried fill material to fill voids underneath slabs is found in U.S. Pat. Nos. 8,186,907 and 8,092,116 each of which is incorporated by reference herein in its entirety.

To introduce the fill material under the structure to fill the space 70, one or more through-holes can be drilled through the structure 20 so that the fill material can be injected into the space 70 via the through-hole(s). Any suitable number of through-holes can be drilled through the structure to achieve appropriate filling. The through-holes can be disposed at any location on the structure 20 one finds suitable for backfilling the space 70. After filling, the through-holes can be filled in an appropriate way, such as by using concrete fill material. Alternatively or in addition to through-holes, the fill material can be injected into the space 70 from one or more sides of the structure 20. For example, with reference to FIG. 4, an injection device can be introduced into the space 70 from the side of and underneath the structure 20 to inject the fill material 72 into the space 70.

After the structure is lifted and the space 70 is filled with fill material, the hose 10 is deflated. However, the lifting and filling steps can be repeated as many times as necessary until the structure 20 is returned to the same level as the remainder of the floor 22.

As mentioned above, this technique can also be used to lift a structure that has not settled but which one wants to lift to a vertical level higher than an original level. For example, one may want to raise a house or a portion thereof off of its foundation, for example to repair the foundation or add a basement. To do so, thick blocking can be added under the hose to incrementally lift the structure. After each incremental lift, support members can be added under the structure, with the structure then being lifted again until it reaches the desired height and supported in place.

Although a single lifting mechanism 5 is illustrated as being used in FIGS. 1-4, multiple lifting mechanisms 5 can be used for lifting the structure 20 or any other structure. For example, with reference to FIG. 5, the lifting mechanism 5 described above can be positioned at and connected to each of the sides of a structure 100 to lift the entire structure. The hoses of the lifting mechanism 5 can be connected to a manifold 62 that is connected to the pressurized media source 60. In this way, the hoses can be simultaneously inflated.

Figure 5:
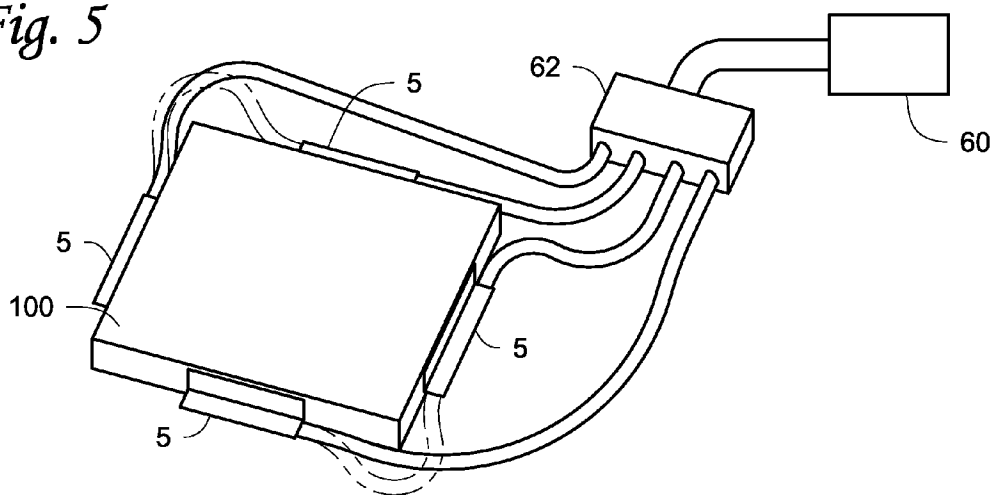
FIG. 5 illustrates a plurality of lift apparatus attached to different locations on a structure and a mechanism for simultaneously inflating the hoses.

In addition, although one hose is illustrated in FIGS. 1-4, two or more hoses can be used underneath each lift bracket. In addition, if more than one lifting mechanism 5 is used, a single hose could be positioned underneath more than one lift bracket to provide the lifting force to each lift bracket when the hose is inflated. This is shown in FIG. 5 in dashed lines showing one hose running underneath two lifting mechanisms 5 and a second hose running underneath the other two lifting mechanisms.

In operation, lifting of a structure is achieved by attaching the lift apparatus 12 to the structure to the raised. The inflatable hose 10 is introduced underneath the lift apparatus, with the inflatable hose being disposed between a bottom surface of the lift apparatus and the ground. The structure is then lifted by inflating the hose with pressurized media, for example air, so that the hose increases in volume to impose an upward force on the lift apparatus.

In one embodiment, the lift apparatus is attached to an edge of the structure to be raised.

In another embodiment, more than one lift apparatus are utilized, attached to different locations on the structure, with an inflatable hose underneath each lift apparatus. The hoses can be simultaneously inflated using pressurized media, or separately inflated.

In one embodiment, fill material is introduced into a space that is created underneath the structure when the structure is lifted. The fill material can comprise dried fill material, for example dried sand.

In one embodiment, multiple lifts of the structure are performed by deflating the hose, and thereafter inflating the hose with pressurized media to again lift the structure.

In another embodiment, a method of raising a structure includes attaching a lift apparatus to the structure to the raised, and positioning an inflatable hose underneath the lift apparatus. The inflatable hose is positioned underneath the lift apparatus so as to be able to impose an upward lifting force on the lift apparatus when the hose is inflated. The hose is then inflated with pressurized media so that the hose increases in volume to impose an upward force on the lift apparatus to lift the structure. Fill material is then introduced into a space that is created underneath the structure when the structure is lifted. Thereafter, the hose is deflated.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method of lifting a structure resting on the ground, comprising:

fixedly attaching a lift apparatus to a lateral edge of the structure to the raised;

introducing an inflatable hose underneath the lift apparatus, the inflatable hose being disposed between a bottom surface of the lift apparatus and the ground; and lifting the structure by inflating the hose with pressurized media so that the hose increases in volume to impose an upward force on the lift apparatus.

2. The method of claim 1, comprising fixedly attaching a plurality of lift apparatus to different locations on one or more lateral edges of the structure;

introducing an inflatable hose underneath each lift apparatus, each inflatable hose being disposed between a bottom surface of the respective lift apparatus and the ground; and lifting the structure by inflating each hose with pressurized media so that each hose increases in volume to impose an upward force on the respective lift apparatus.

3. The method of claim 2, comprising simultaneously inflating each hose with pressurized media.

4. The method of claim 1, further comprising introducing fill material into a space that is created underneath the structure when the structure is lifted.

5. The method of claim 4, wherein the fill material comprises dried fill material.

6. The method of claim 5, wherein the dried fill material comprises sand.

7. The method of claim 4, further comprising deflating the hose and thereafter inflating the hose with pressurized media to again lift the structure.

8. The method of claim 1, wherein the pressurized media comprises air.

9. A method of raising a structure, comprising:

rigidly fixing a lift apparatus to a lateral edge of the structure to be raised;

positioning an inflatable hose underneath the lift apparatus, the inflatable hose being positioned underneath the lift apparatus so as to be able to impose an upward lifting force on the lift apparatus when the hose is inflated;

inflating the hose with pressurized media so that the hose increases in volume to impose an upward force on the lift apparatus to lift the structure;

introducing fill material into a space that is created underneath the structure when the structure is lifted; and thereafter deflating the inflated hose.

10. The method of claim 9, comprising rigidly fixing a plurality of lift apparatus to different locations on one or more lateral edges of the structure;

introducing an inflatable hose underneath each lift apparatus, each inflatable hose being disposed between a bottom surface of the respective lift apparatus and the ground; and lifting the structure by inflating each hose with pressurized media so that each hose increases in volume to impose an upward force on the respective lift apparatus.

11. The method of claim 10, comprising simultaneously inflating each hose with pressurized media.

12. The method of claim 9, wherein the fill material comprises dried fill material.

13. The method of claim 12, wherein the dried fill material comprises sand.

14. The method of claim 9, after deflating the hose, repeating the inflating and introducing fill material steps at least a second time.

* * * * *